US010047661B1

(12) United States Patent
Torgerud

(10) Patent No.: US 10,047,661 B1
(45) Date of Patent: Aug. 14, 2018

(54) APPARATUSES AND SYSTEMS FOR COOLING FUEL MODULES FOR MARINE ENGINES

(71) Applicant: Brunswick Corporation, Lake Forest, IL (US)

(72) Inventor: Michael A. Torgerud, Mt. Calvary, WI (US)

(73) Assignee: Brunswick Corporation, Mettawa, IL (US)

( * ) Notice: Subject to any disclaimer, the term of this patent is extended or adjusted under 35 U.S.C. 154(b) by 76 days.

(21) Appl. No.: 15/432,010

(22) Filed: Feb. 14, 2017

(51) Int. Cl.
*F02M 31/20* (2006.01)
*F01P 3/20* (2006.01)
*B63H 20/28* (2006.01)

(52) U.S. Cl.
CPC ..... *F01P 3/207* (2013.01); *B63H 20/28* (2013.01); *B63B 2770/00* (2013.01); *F01P 2050/04* (2013.01); *F01P 2060/10* (2013.01)

(58) Field of Classification Search
CPC .... F01P 3/207; F01P 2060/10; F02P 1050/04; B63H 20/28; B63B 2770/00
USPC ..... 123/541
See application file for complete search history.

(56) References Cited

U.S. PATENT DOCUMENTS

| | | | | |
|---|---|---|---|---|
| 4,728,306 | A | 3/1988 | Schneider | |
| 4,848,283 | A | 7/1989 | Garms et al. | |
| 5,647,331 | A | 7/1997 | Swanson | |
| 5,887,555 | A * | 3/1999 | Schmitz | F02M 31/20 123/41.31 |
| 5,908,020 | A | 6/1999 | Boutwell et al. | |
| 6,009,859 | A * | 1/2000 | Roche | F02M 25/0872 123/41.31 |
| 6,322,410 | B1 | 11/2001 | Harvey | |
| 6,415,773 | B1 * | 7/2002 | Katayama | F02B 61/045 123/514 |
| 6,899,580 | B1 | 5/2005 | Kollmann | |
| 7,101,239 | B1 | 9/2006 | Torgerud et al. | |
| 7,112,110 | B1 | 9/2006 | Kollmann | |
| 7,178,512 | B1 | 2/2007 | Merten | |
| 7,395,814 | B1 | 7/2008 | Doepke et al. | |
| 7,832,380 | B1 | 11/2010 | Abou Zeid et al. | |
| 9,234,483 | B2 | 1/2016 | Achor et al. | |
| 2006/0124113 | A1 * | 6/2006 | Roberts, Sr. | F02M 31/20 123/541 |
| 2009/0111338 | A1 * | 4/2009 | Fujino | B63B 35/731 440/1 |

* cited by examiner

*Primary Examiner* — Marguerite McMahon
(74) *Attorney, Agent, or Firm* — Andrus Intellectual Property Law, LLP

(57) ABSTRACT

A fuel module apparatus is for a marine engine. The fuel module apparatus includes a housing having a fuel cavity and a fuel pump in the housing. The fuel pump is configured to pump fuel through the fuel cavity from an inlet on the housing to an outlet on the housing. A cooling fluid sprayer sprays cooling fluid onto an outer surface of the housing to thereby cool the housing and the fuel in the fuel cavity.

20 Claims, 9 Drawing Sheets

APPARATUSES AND SYSTEMS FOR COOLING FUEL MODULES FOR MARINE ENGINES

FIELD

The present disclosure relates to marine engines, and more particular to fuel modules for marine engines and apparatuses and systems for cooling fuel modules for marine engines.

BACKGROUND

The following U.S. Patents are incorporated herein by reference.

U.S. Pat. No. 4,728,306 discloses a marine propulsion auxiliary cooling system provided by an electric auxiliary water pump, pumping sea water to cool the engine and/or fuel line after turn off of the engine to prevent vaporization of the fuel, or in response to another given engine condition.

U.S. Pat. No. 7,101,239 discloses a marine propulsion device provided with a fuel filter that is connectable between a fuel tank and a fuel pump, wherein the fuel filter is disposed below an adapter plate of the marine propulsion device. The adapter plate is located between the fuel filter and the engine so that the fuel filter is not located under the cowl of the marine propulsion device where an engine is housed.

U.S. Pat. No. 7,178,512 discloses a fuel container for a marine propulsion system provided with a pump and a hose connected to an outlet of the pump and disposed within the cavity of the fuel container. The hose is provided with an opening, formed through its wall, through which a fluid can flow under certain circumstances. The opening is disposed in an ullage within the container and allows gaseous elements to be purged from the container when flow is induced from the container back to a fuel reservoir.

U.S. Pat. No. 7,395,814 discloses a fuel system for a marine propulsion device that controls the pressure of liquid fuel within a fuel rail by altering the pump speed of a fuel pump. The fuel pressure in the rail is measured by a pressure transducer which provides an output signal to a microprocessor that allows the microprocessor to select an operating speed for the fuel pump that conforms to a desired fuel pressure in the rail. By decreasing or increasing the operating speed of the positive displacement fuel pump as a function of the measured pressure in the rail, the microprocessor can accurately regulate the fuel pressure.

U.S. Pat. No. 7,832,380 discloses a marine engine fuel system that provides a low pressure lift pump to draw fuel from a fuel tank and cause the fuel to flow into a reservoir and a high pressure fuel pump which draws fuel from the reservoir and provides it to a fuel rail. An inlet conduit of the high pressure fuel pump is provided with a primary and a secondary opening. The secondary opening can be an orifice formed through a wall of the inlet conduit. The secondary opening is positioned, relative to the primary opening, at a location which assists in controlling the fuel level within the reservoir and the quantity of gaseous fuel contained within an ullage above the liquid pool of fuel.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In examples disclosed herein, a fuel module apparatus is for a marine engine. The fuel module apparatus comprises a housing with a fuel cavity and a fuel pump in the housing. The fuel pump is configured to pump fuel through the fuel cavity from an inlet on the housing to an outlet on the housing. A cooling fluid sprayer is configured to spray cooling fluid onto an outer surface of the housing to thereby cool the housing and the fuel in the fuel cavity. A system is also disclosed for cooling the fuel module. The system comprises the fuel module having the fuel cavity and the fuel pump, and the cooling fluid sprayer that sprays cooling fluid onto the outer surface of the fuel module to thereby cool the fuel module and the fuel in the fuel cavity. A cooling fluid circuit supplies the cooling fluid to the cooling fluid sprayer and a cooling fluid pump pumps cooling fluid through the cooling fluid circuit.

BRIEF DESCRIPTION OF THE DRAWINGS

Examples of apparatuses for outboard marine engines are described with reference to the following drawing figures. The same numbers are used throughout the drawing figures to reference like features and components.

DETAILED DESCRIPTION OF THE DRAWINGS

The present inventor has endeavored to improve upon fuel systems for marine engines, for example the fuel systems described in the above-incorporated U.S. Pat. Nos. 7,178,512; 7,395,814; and 7,832,380. The present inventor has recognized that power consumption and associated heat generated within the fuel module of such systems requires cooling. This typically is achieved via a heat exchanger contained within or located external to the fuel module. During research and development, the present inventor has determined that the heat exchanger components potentially can leak water and/or fuel, for example at the interfaces of the respective components. The present inventor has also realized that in certain examples it is desirable to cool the fuel in the fuel module when the marine engine is turned off (e.g., during periods of non-use). Conventional heat exchangers typically rely upon a mechanical cooling fluid pump that is powered by the marine engine only during periods of use. One example of such an arrangement is disclosed in the above-incorporated U.S. Pat. No. 4,728,306.

The present disclosure is a result of the present inventor's efforts to improve upon these prior art systems in a way that overcomes the above-mentioned drawbacks.

The present disclosure stems from the inventor's discovery that it is possible and can be advantageous to externally cool the fuel module by spraying cooling fluid (which can include any type of cooling fluid, for example water from the body of water in which the marine engine is operating) onto the outer surfaces of the fuel module, thereby eliminating the above-noted failure mode of at the interfaces of heat exchanger components and within the fuel module itself. The present disclosure also stems from the inventor's discovery that it is possible and can be advantageous to provide an electric pump that pumps the cooling fluid for spraying onto the fuel module, thereby allowing cooling of the fuel module when the marine engine is not being used. Optionally, the electric pump can be operated as directed by a controller and/or temperature sensor feedback. The location of the temperature sensor can vary, and for example can be in a variety of locations, including on the fuel system and/or on the internal combustion engine. Further examples are disclosed herein below.

Figure 1:
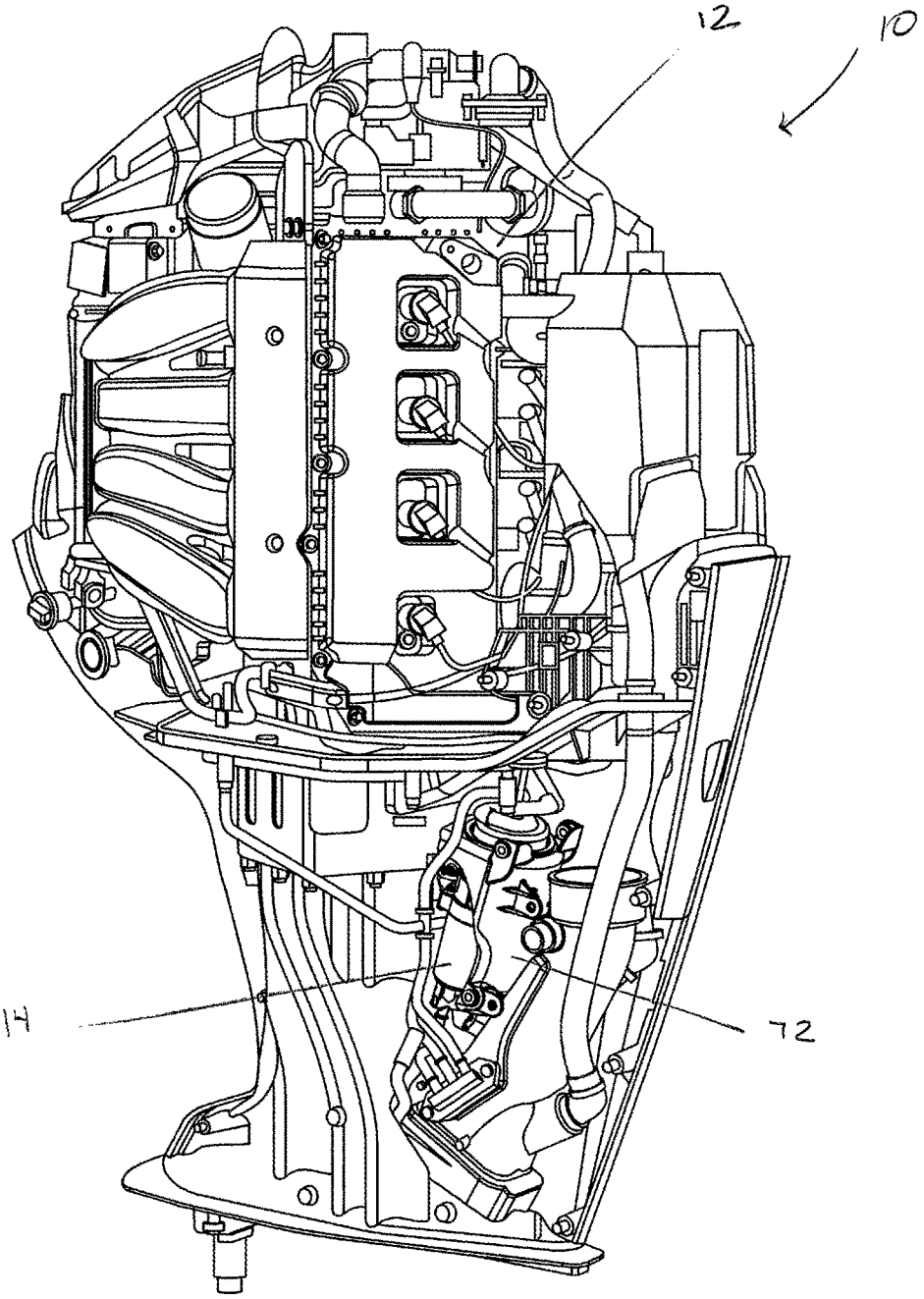
FIG. 1 is a side view of an outboard marine engine having a fuel module.

FIG. 1 depicts an outboard marine engine 10 for propelling a marine vessel. The outboard marine engine 10 includes an internal combustion engine 12 that receives fuel from a fuel module 14, as is conventional. The particular manner in which the fuel from the fuel module 14 is supplied to the internal combustion engine 12 is conventional and can for example include one or more fuel rails, fuel injectors, and/or the like. Suitable examples of fuel supply systems are provided in the above-incorporated U.S. patents.

Figure 2:
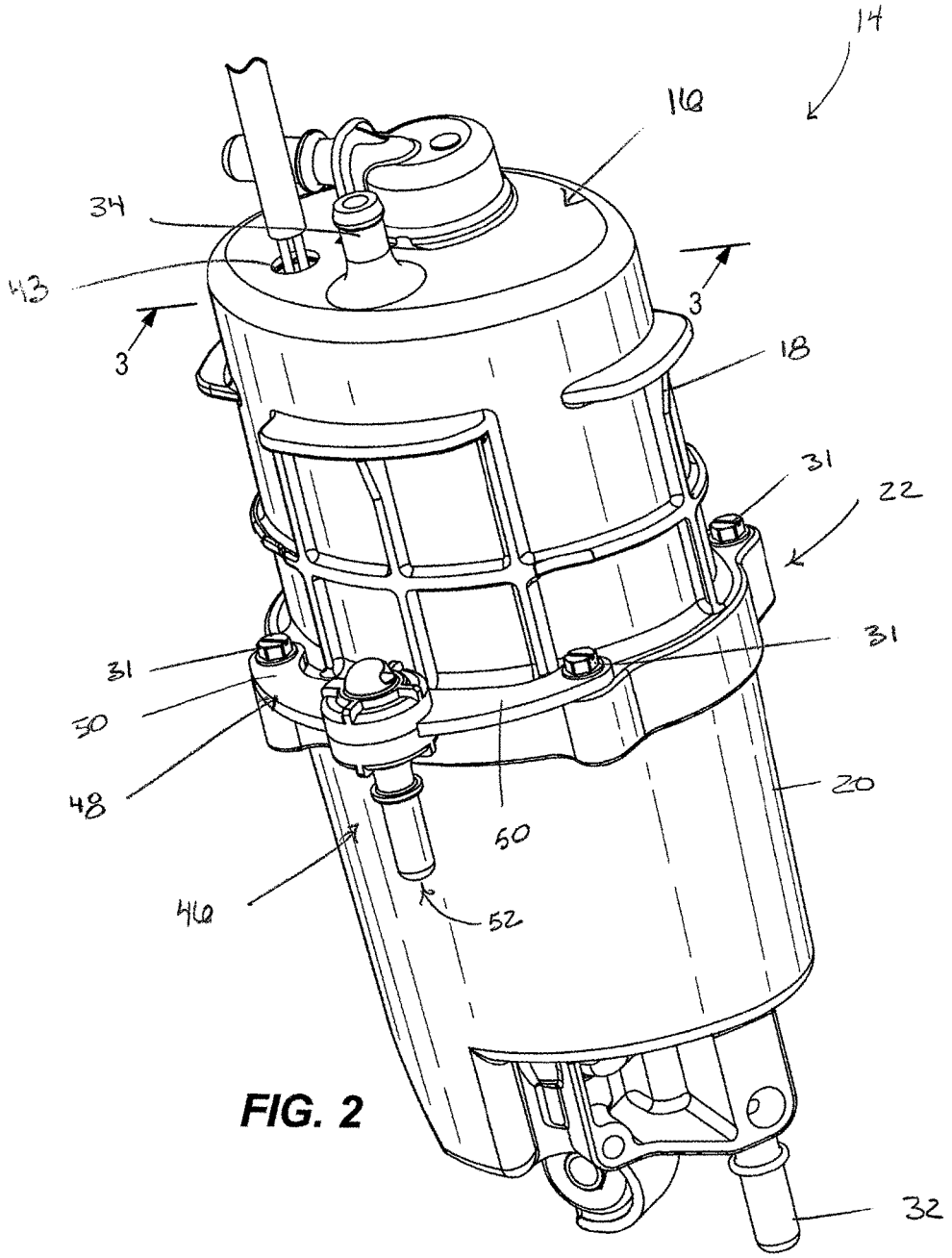
FIG. 2 is a perspective view of the fuel module having a cooling fluid sprayer.
Figure 3:
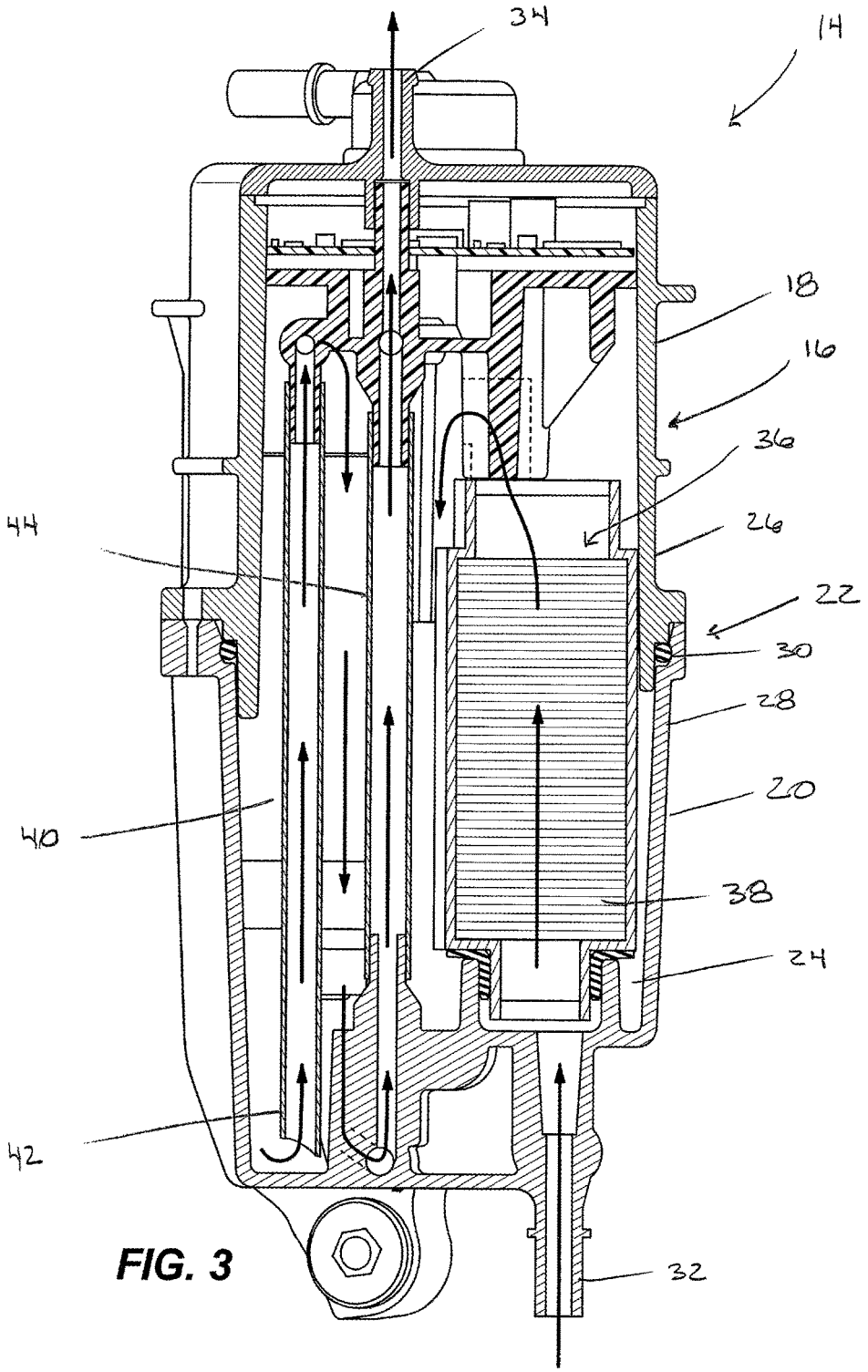
FIG. 3 is a view of section 3-3 taken in FIG. 2.

Referring to FIGS. 2 and 3, the fuel module 14 has a housing 16 that includes an upper portion 18 connected to a lower portion 20 at a sealed juncture 22, to thereby define a sealed interior fuel cavity 24. The exact configuration of the housing 16 and sealed interior fuel cavity 24 can vary from what is shown. In the illustrated example, the upper portion 18 has peripheral sidewalls 26 that nest in peripheral sidewalls 28 of the lower portion 20, with a radial seal 30 sandwiched there between so as to prevent fuel within the fuel cavity 24 from leaking from the fuel module 14. A plurality of fasteners (e.g. bolts) 31 axially extend through the upper and lower portions 18, 20 at the sealed juncture 22 to fasten the upper and lower portions 18, 20 together and compress the radial seal 30, thus sealing the interior fuel cavity 24.

As shown in FIGS. 2 and 3, the fuel module 14 includes a fuel inlet 32 and a fuel outlet 34. A fuel pumping system 36 is disposed in the interior fuel cavity 24 and is configured to pump fuel from the fuel inlet 32 to the fuel outlet 34 and then through the above-noted fuel system to the internal combustion engine 12. The exact configuration of the fuel pumping system 36 can vary widely from that which is shown and described. Examples of suitable fuel pumping systems are disclosed in the above-incorporated U.S. Patents. In the illustrated example, the fuel pumping system 36 includes first and second pumps 38, 40 disposed in the fuel cavity 24. The type of pump can vary and for example can include a DC brushless motor. Electrical power and ground connections to the first and second pumps 38, 40 are provided through a sealed through-bore 43 in the upper portion 18 of the housing 16. The first (lift) pump 38 is configured to pump fuel from the fuel inlet 32, upwardly into the fuel cavity 24. Under force from the first (lift) pump 38 and under force from gravity, the fuel fills the fuel cavity 24 around the first and second pumps 38, 40, for example along and adjacent to the sidewalls 26, 28. The second pump 38 draws the fuel from the fuel cavity 24 via fuel pickup tube 42 and pumps the fuel to the fuel outlet 34 via a fuel outlet conduit 44. A (not shown) controller, including for example a printed circuit board, controls operation of the first and second pumps 38, 40, as described in the above-incorporated U.S. patents. In some examples, the controller is disposed in the housing 16. Again the configuration of the fuel pumping system 36 can vary from that which is shown.

Figure 4:
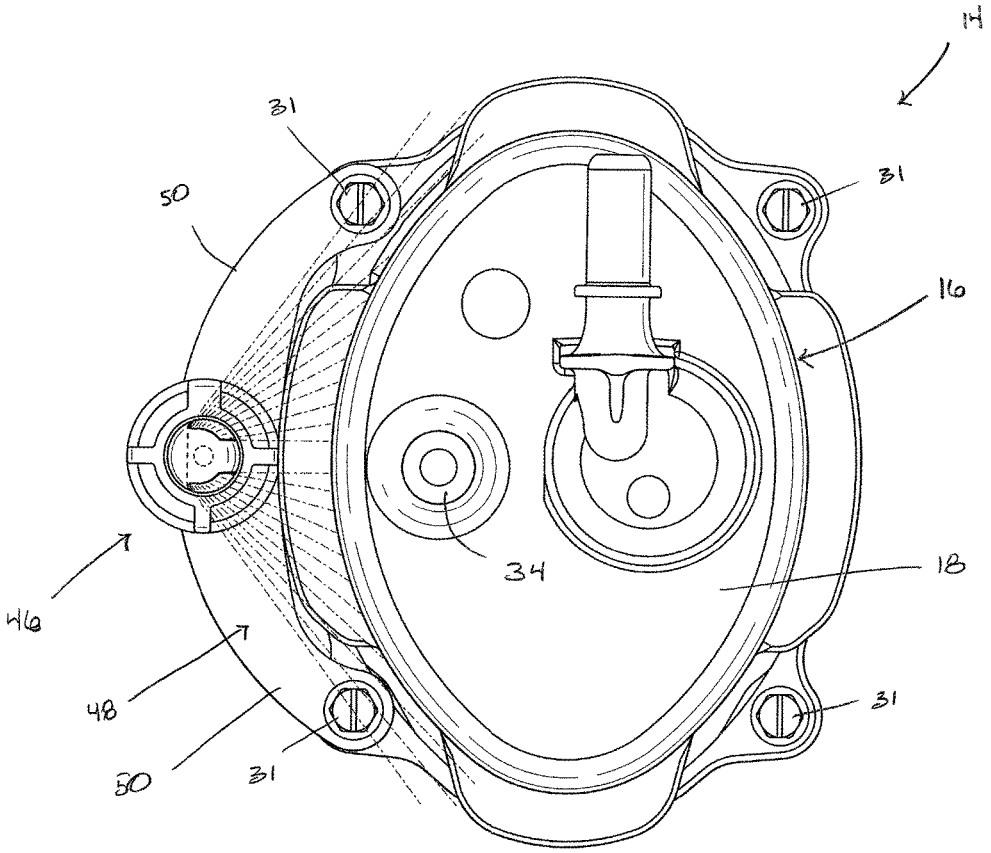
FIG. 4 is a top view of the fuel module and cooling fluid sprayer.
Figure 5:
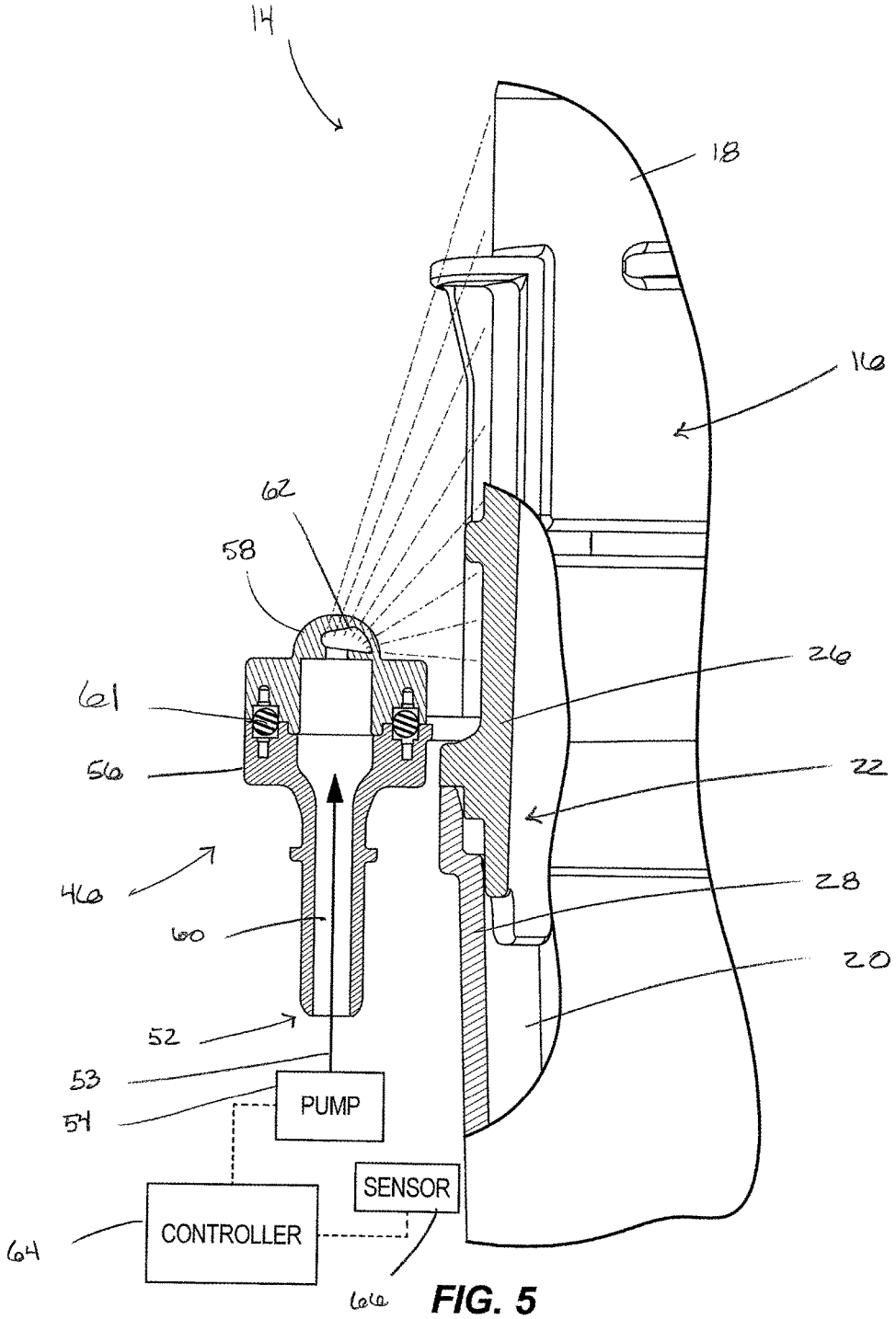
FIG. 5 is a partial sectional view of the fuel module and a full sectional view of the cooling fluid sprayer.
Figure 6:
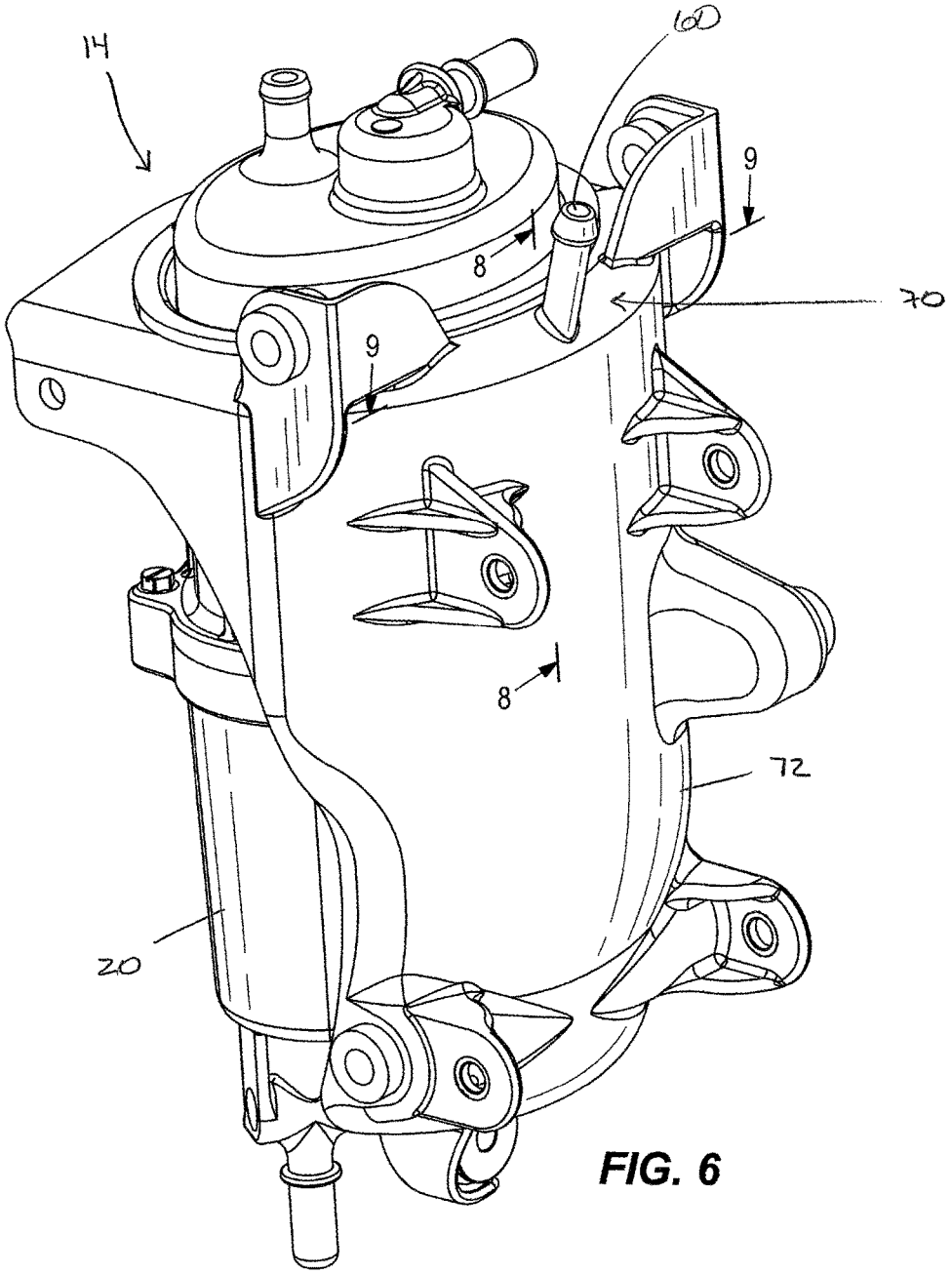
FIG. 6 is a perspective view of another example of the fuel module and a cooling fluid sprayer.
Figure 7:
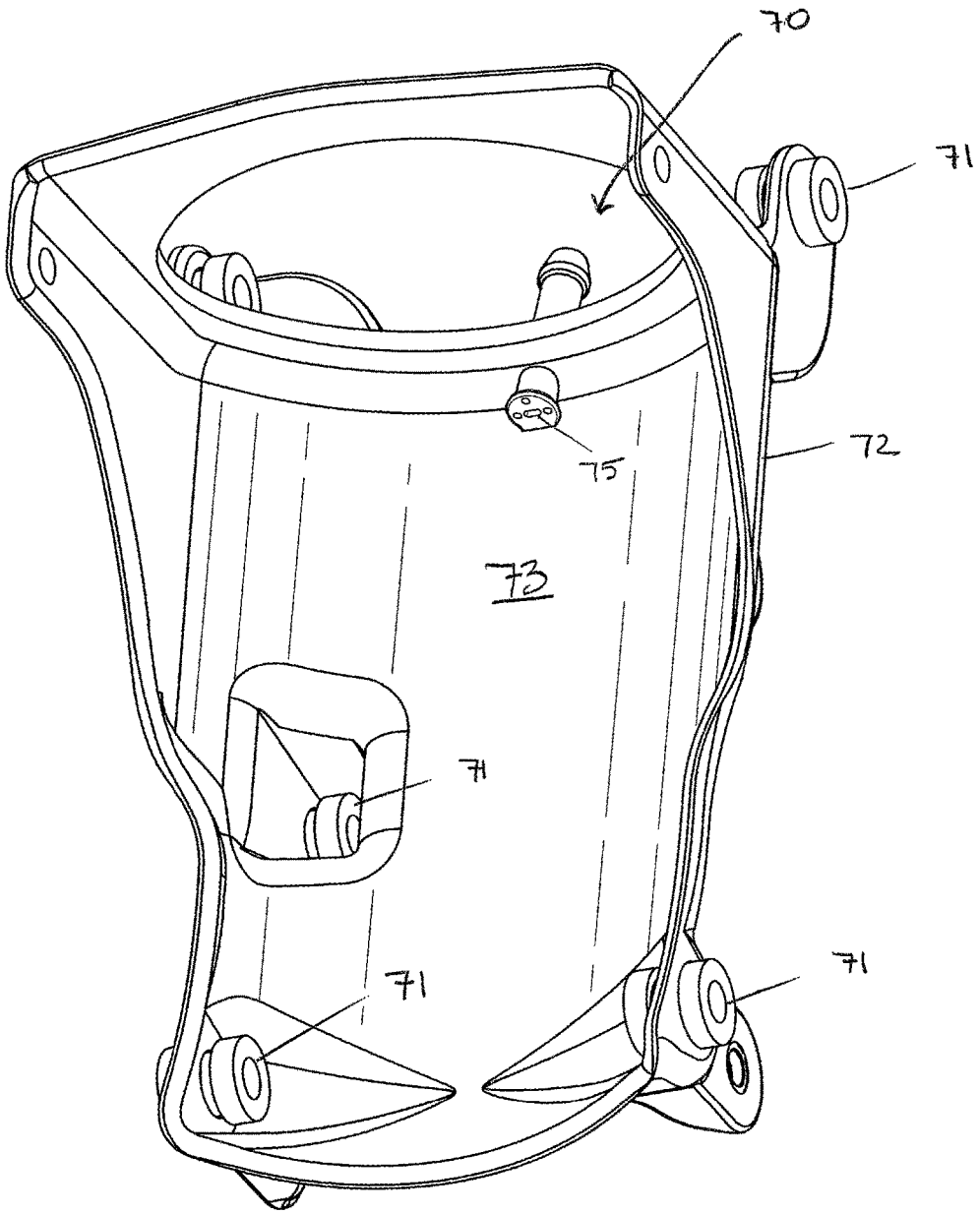
FIG. 7 is a view of a supporting cradle for the fuel module, the supporting cradle incorporating the cooling fluid sprayer.
Figure 8:
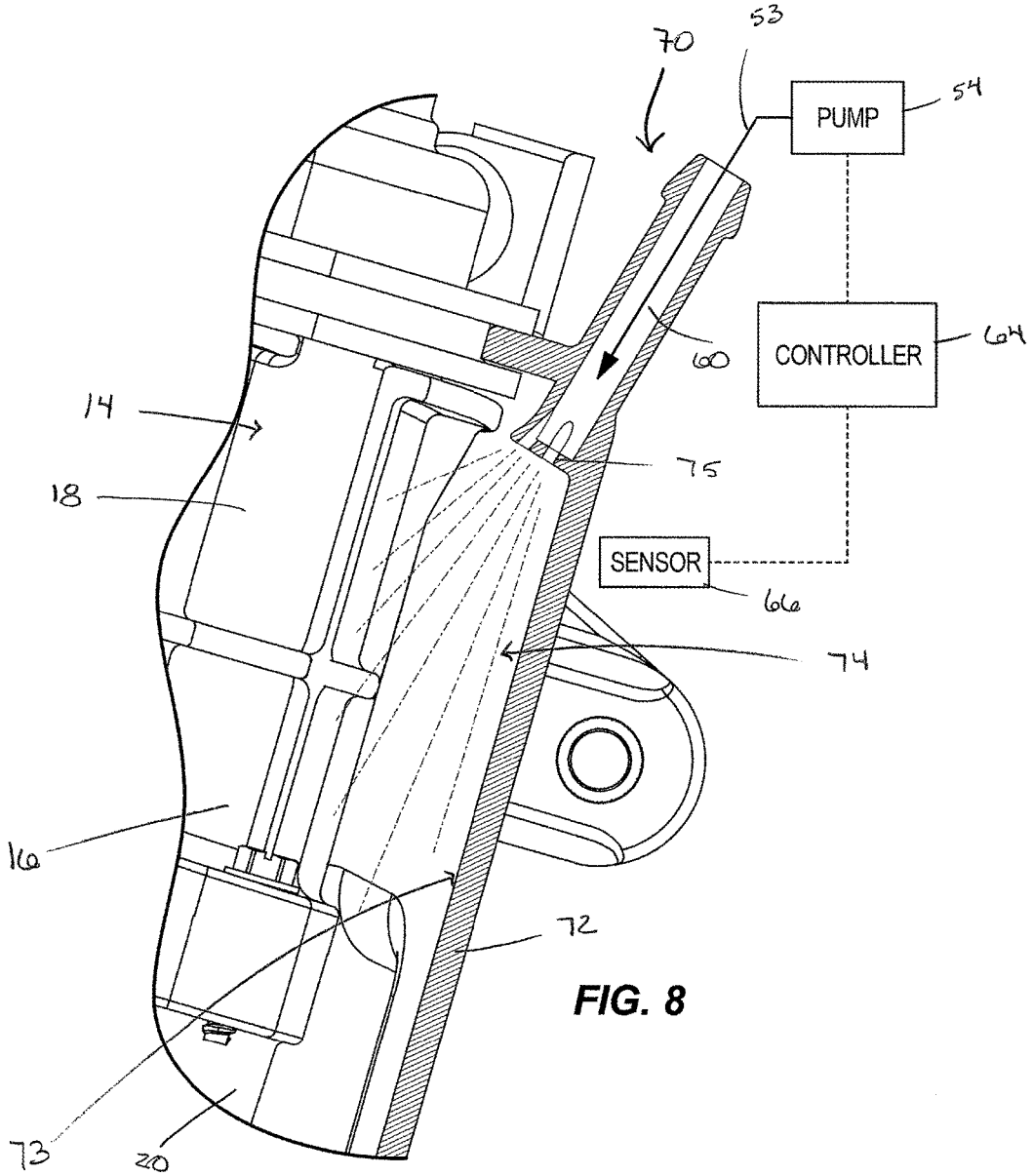
FIG. 8 is a view of section 8-8 taken in FIG. 6.
Figure 9:
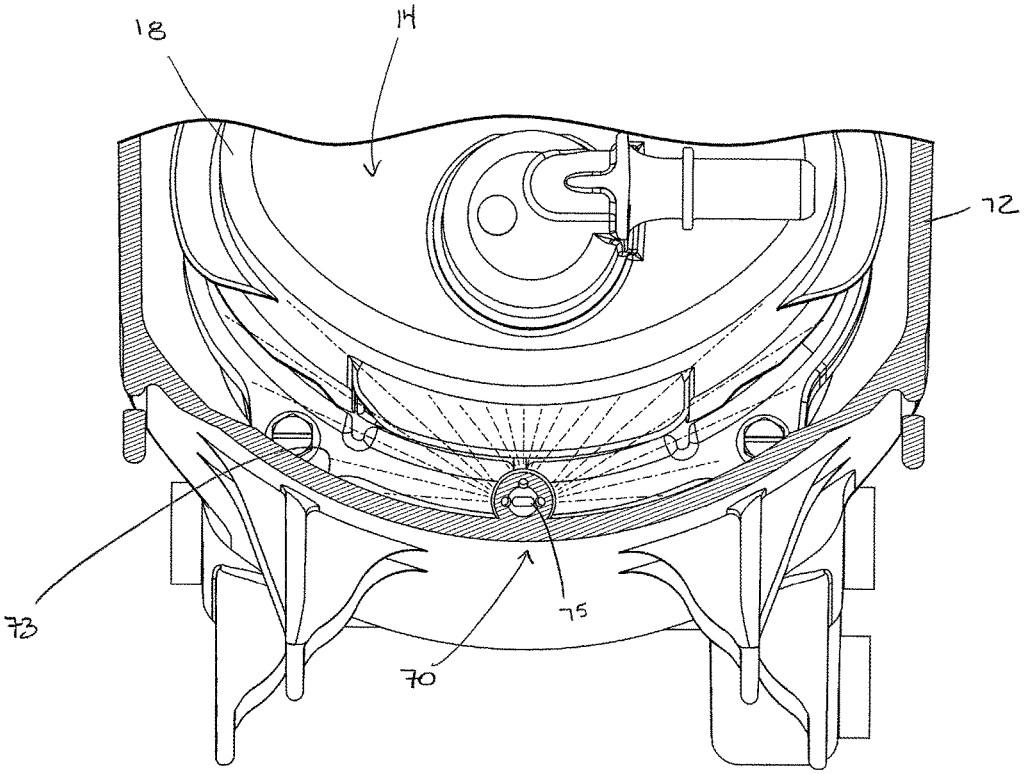
FIG. 9 is a view of section 9-9 taken in FIG. 6.

Referring to FIGS. 4 and 5, according to the present disclosure, a cooling fluid sprayer 46 is configured to spray relatively cold cooling fluid onto the relatively warm outer surfaces of the housing 16 to thereby cool the housing 16 and the fuel contained within the fuel cavity 24. The exact configuration of the cooling fluid sprayer 46 can vary from what is shown. Also, one or more cooling fluid sprayers 46 can be provided to cool the housing 16 and fuel therein. The location of the cooling fluid sprayer 46 can vary from what is shown, and can be directly attached to the housing 16 or coupled to a surrounding structure on the outboard marine engine 10. In the particular example shown in FIGS. 4 and 5, the cooling fluid sprayer 46 is coupled to the housing 16 by a clip or bracket 48. The configuration of the bracket 48 can vary from what is shown. In the illustrated example, the bracket 48 has opposing arms 50 that are curved so as to extend generally parallel to the outer periphery of the housing 16 along the juncture 22. Each arm 50 has a through-bore through which one of the fasteners 31 extends to thereby couple the bracket 48 and associated cooling fluid sprayer 46 to the housing 16.

In FIGS. 4 and 5, the cooling fluid sprayer 46 includes an inlet 52 that receives cooling fluid from a cooling fluid circuit 53 that includes a cooling fluid pump 54 that pumps the cooling fluid through the cooling fluid circuit 53. Although not shown, in some examples, the cooling fluid circuit 53 can be an open circuit having an inlet located below water line during use of the marine engine 10 so that the cooling fluid pump 54 draws relatively cold water from the body of water into the cooling fluid circuit 53. In other examples, the cooling fluid circuit 53 can be a closed circuit that recycles and/or reuses cooling fluid. The cooling fluid sprayer 46 includes a sprayer body 56 and a sprayer head 58 that is connected to the sprayer body 56 in a water-tight manner via an O-ring seal 61. The sprayer head 58 is configured to spray the cooling fluid on the upper portion 18 of the housing 16 so that the cooling fluid drains by gravity down the upper portion 18 and lower portion 20, and then to the lower portion of the surrounding driveshaft housing on the outboard marine engine 10. The cooling fluid sprayer 46 has a through-bore 60 through which the cooling fluid is conveyed and a deflector 62 in the sprayer head 58 is angled with respect to the through-bore 60 so as to deflect (i.e. break up, disperse, spray) the cooling fluid towards the housing 16 (see the dash-and-dot lines in FIG. 5). In other words, the cooling fluid impinges on the deflector 62 and is broken up into smaller particles, thereby enhancing the spray effect and facilitating heat exchange. In the illustrated embodiment, the fuel in the fuel cavity 24 is advantageously located adjacent the inner wall of the housing 16 so that the fuel efficiently exchanges heat with the cooling fluid that is sprayed onto the outer wall of the housing 16. That is, the first and second pumps 38, 40 are spaced apart from the inner wall of the housing 16, allowing the fuel to reside between the first and second pumps 38, 40 and the housing 16. The inventor has also found that in some examples is preferable to provide a housing 16 with relatively smooth outer surfaces (i.e. devoid of geometry that would catch and retain water) so that the potential for freeze damage is limited.

Optionally the cooling fluid pump 54 can be an electric pump that is operable during both periods of use and non-use of the internal combustion engine 12, even for example when there outboard marine engine 10 is off and trimmed up into a position of non-use. The cooling fluid pump 54 can be located on the outboard marine engine 10. In other examples, the cooling fluid pump 54 can be mounted to the marine vessel on which the marine engine 10 is mounted, for example the transom of the marine vessel below the water line. The cooling fluid circuit 53 connects the cooling fluid pump 54 to the cooling fluid sprayer 46 and can have various other connections for alternate uses of the cooling fluid in association with other components of the marine engine.

Operation of the cooling fluid pump 54 can be controlled by a computer controller 64 having a processor and a memory for storing computer programming according to which the processor operates. In some examples, the controller 64 can be programmed to cause the cooling fluid pump 54 to operate based upon input from a temperature sensor 66 associated with the outboard marine engine 10. The type and location of temperature sensor can vary. In some examples, the temperature sensor 66 is configured to sense the temperature of the fuel in the fuel system and the controller 64 is configured to operate the cooling fluid pump 54 to maintain the temperature of the fuel below a threshold temperature stored in the memory, or within a temperature range stored in the memory. That is, the controller 64 can be programmed to control the cooling fluid pump 54 based upon feedback from the temperature sensor 66, which for example can include the temperature of the fuel. In some examples, the temperature sensor 66 can be configured to sense ambient temperature in which the outboard marine engine 10 is operating, and the controller 64 can be configured to control the cooling fluid pump 54 based upon the ambient temperature. In some examples, the temperature sensor 66 can be configured to sense temperature of the internal combustion engine 12 and the controller 64 can be configured to control the cooling fluid pump 54 based upon the temperature of the internal combustion engine 12. One or more than one temperature sensors 66 can be provided and the controller 64 can be configured to operate in conjunction with multiple types of temperature sensors 66, such as combinations of the temperature sensors described herein.

FIGS. 6-9 depict another example having an alternate example of a cooling fluid sprayer 70, which contrary to the cooling fluid sprayer 46, is integrated or attached to a supporting cradle 72 for supporting the fuel module 14 with respect to the outboard marine engine 10 (see FIG. 1). The supporting cradle 72 is mounted in place by resilient (e.g. rubber) mounts 71 for limiting vibration of the fuel module 14. In this example, the cooling fluid sprayer 70 is coupled to the housing 16, via the cradle 72 and is configured to spray the cooling fluid onto the housing 16 in a space 74 between the housing 16 and an interior cradle surface 73 of the cradle 72. The interior cradle surface 73 has a curvature that generally corresponds to the outer curvature of the housing 16. The location and orientation of the cooling fluid sprayer 70 on the supporting cradle 72 can vary from that which is shown. In the illustrated example, the cooling fluid sprayer 70 is advantageously located vertically above the lower portion 20 and oriented to spray cooling fluid downwardly onto the upper portion 18 so that the cooling fluid impinges on the housing 16 and then drains by gravity down and off of the housing 16, while exchanging heat with the sidewalls of the housing 16 and fuel contained therein. The cradle 72 thus advantageously shields the cooling fluid from outside elements as it drains down the outer surfaces of the housing 16 and better facilitates heat exchange between the relatively hot fuel in the housing 16 and the relatively cold cooling fluid on the outer surfaces of the housing 16.

The exact configuration of the cooling fluid sprayer 70 can vary from what is shown. In the illustrated example, the cooling fluid sprayer 70 has the above-described through-bore 60. A plurality of narrow deflector passages 75 are disposed on the outlet end of the through-bore 60. The narrow deflector passages 75 are configured such that the cooling fluid, under pressure from the cooling fluid pump 54, is forced through the narrow deflector passages 75 and thus caused to break apart into smaller particles and spray (see the dash-and-dot lines in FIGS. 8 and 9) onto the outer surfaces of the housing 16. The narrow deflector passages 75 can be formed to direct the cooling fluid onto the housing 16 in a wide spray pattern, thereby enhancing the heat exchange effect.

According to examples described herein above, the present inventor was able to solve the above-mentioned drawbacks of conventional systems by flooding the external surfaces of the fuel module with cooling fluid from an externally mounted cooling fluid pump and sprayer directed towards the fuel module. This advantageously allows cooling of the fuel in the fuel module without adding fuel leak pathways and avoiding issues with respect to corrosion of prior art heat exchanger arrangements. Using the temperature sensor allows the electric pump to cool the fuel module during an engine off state, for example even when the outboard marine engine is trimmed out of the water. The added heatsoak cooling prevents hot fuel handling situations, even during extreme operating conditions. In some examples, the electric pump can also be used to cool other components, such as for example fuel lines and/or fuel filters. The space 74 between the housing 16 and the cradle 72 provides a shielded cavity that retains the cooling fluid in close proximity to the housing 16 and facilitates heat exchange.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A fuel module apparatus for a marine engine, the fuel module apparatus comprising a housing having a fuel cavity; a fuel pump in the housing, wherein the fuel pump is configured to pump fuel through the fuel cavity from an inlet on the housing to an outlet on the housing; and a cooling fluid sprayer configured to spray cooling fluid onto an outer surface of the housing to thereby cool the housing and the fuel in the fuel cavity.

2. The fuel module according to claim 1, wherein the cooling fluid sprayer is coupled to the housing.

3. The fuel module according to claim 2, further comprising a cradle that supports the housing with respect to the marine engine and wherein the cooling fluid sprayer is coupled to the housing via the cradle.

4. The fuel module according to claim 3, wherein the cooling fluid sprayer sprays the cooling fluid onto the outer surface of the housing between the housing and the cradle.

5. The fuel module according to claim 4, wherein the cooling fluid sprayer sprays the cooling fluid onto the housing so that the cooling fluid drains by gravity down a sidewall of the housing and then off the housing.

6. The fuel module according to claim 5, wherein the cradle has an inner surface that faces a sidewall of the housing and wherein the cooling fluid sprayer is configured to spray the cooling fluid onto the sidewall so that the cooling water is shielded between the inner surface and the sidewall.

7. The fuel module according to claim 2, further comprising a bracket that couples the cooling fluid sprayer to the housing.

8. The fuel module according to claim 7, wherein the housing comprises upper and lower portions that are coupled together at a junction, and wherein the bracket is coupled to the housing along the junction.

9. The fuel module according to claim 1, wherein the cooling fluid sprayer is configured to spray cooling fluid on an upper portion of the housing so that the cooling fluid drains by gravity to a lower portion of the housing.

10. The fuel module according to claim 1, wherein the fuel cavity retains the fuel against an inner sidewall of the housing, and wherein the cooling fluid sprayer is configured to spray the cooling fluid onto an outer sidewall of the housing, opposite the inner sidewall of the housing, thereby efficiently causing heat exchange between the cooling fluid and the fuel.

11. The fuel module according to claim 1, further comprising a clip that fastens the cooling fluid sprayer to the housing.

12. The fuel module according to claim 1, wherein the cooling fluid sprayer has a through-bore and a deflector that is configured to break up and deflect the cooling fluid onto the housing.

13. A system for cooling a fuel module for a marine engine, the system comprising a fuel module having a fuel cavity and a fuel pump, wherein the fuel pump is configured to pump fuel through the fuel cavity; a cooling fluid sprayer that is configured to spray cooling fluid onto an outer surface of the fuel module to thereby cool the fuel module and the fuel in the fuel cavity; a cooling fluid circuit that supplies the cooling fluid to the cooling fluid sprayer; and a cooling fluid pump that pumps the cooling fluid through the cooling fluid circuit.

14. The system according to claim 13, wherein the cooling fluid pump is operable when the marine engine is off.

15. The system according to claim 14, wherein the cooling fluid pump is an electric pump.

16. The system according to claim 13, further comprising a temperature sensor that senses a temperature associated with the marine engine, wherein the cooling fluid pump is operated based upon the temperature.

17. The system according to claim 13, further comprising a temperature sensor that senses a temperature associated with the fuel in the fuel module, wherein the cooling fluid pump is operated based upon the temperature.

18. The system according to claim 13, further comprising a controller that is configured to control the cooling fluid pump based upon feedback from a temperature sensor.

19. The system according to claim 18, wherein the controller is configured to control the cooling fluid pump based upon ambient temperature and based upon feedback from the temperature sensor.

20. The system according to claim 13, wherein the marine engine is mounted to a transom of a marine vessel and wherein the cooling fluid pump is mounted to the marine vessel.

* * * * *